United States Patent [19]

Leinenbach

[11] 4,358,052

[45] Nov. 9, 1982

[54] HOT-WATER CENTRAL HEATING SYSTEM

[76] Inventor: Dieter J. Leinenbach, Eisenbahnstrasse 22, Merchweiler/Saar, Fed. Rep. of Germany, 6689

[21] Appl. No.: 179,524

[22] Filed: Aug. 19, 1980

[30] Foreign Application Priority Data

Aug. 21, 1979 [EP] European Pat. Off. ..... 79103059

[51] Int. Cl.[3] ..... F24D 3/00

[52] U.S. Cl. ..... 237/8 R; 126/133; 237/55

[58] Field of Search ..... 237/8 R, 55; 126/132, 126/133

[56] References Cited

U.S. PATENT DOCUMENTS 4,147,301 4/1979 Halma et al. ..... 237/8 R

FOREIGN PATENT DOCUMENTS 914311 5/1954 Fed. Rep. of Germany .

1904539 10/1972 Fed. Rep. of Germany .

2389842 12/1978 France ..... 237/8 R

*Primary Examiner*—Ronald C. Capossela

*Attorney, Agent, or Firm*—John J. Dennemeyer

[57] ABSTRACT

A hot water central heating system with a conduit system conducting a water flow and comprising intercommunicating pipes which intersect in decks and substantially fills the cross-section of the combustion chamber of a boiler and offers a large flow resistance to the firing gases in order to lower the exhaust gas temperature. A pressure limiting valve disposed upstream of the circulating pump protects the hot water conduit system against excessive pressure resulting from the formation of vapor. Corrosion-resistant lining of the exhaust gas chimney by means of an internally enamelled pipe is recommended owing to the low exhaust gas temperature which can be reached. Fuel is continuously supplied to the burner, the fuel flow rate being modulated by a controller responsive to heat sensor means placed in the hot-water outlet of the boiler.

11 Claims, 2 Drawing Figures

HOT-WATER CENTRAL HEATING SYSTEM

BACKGROUND OF THE INVENTION

1. Field of the Invention

The invention relates to a hot-water central heating system with a boiler, which surrounds a combustion chamber, a burner situated beneath the combustion chamber and a hot-water conduit system which is situated above the burner and is provided with a cold-water inflow and a hot-water outflow. Normally, the conduit system for the hot water is disposed on the walls of the combustion chamber so that the firing gases are able to rise without impediment and emerge laterally into the exhaust duct no higher than at a blocked zone situated on the top conduit system on the cover side. By restricting the exhaust cross-section with a smoke-gas butterfly flap it is possible to restrict the velocity of the exhaust gases, but heat utilization of the firing gases is poor, especially when the highest heating output is required and the butterfly flap is fully opened, because such firing gases give up their heat predominantly by radiation and only to a small extent by convection.

It is also known from the German Patent Specification 24 48 790 to dispose a plurality of decks or spiral pipe coils in serial configuration in the combustion chamber of a heating boiler so as to fully utilize the central zone above the combustion chamber as a heat transmitting part. The flow resistance offered to the rising firing gases by the pipe decks is relatively low since the pipe coils are superjacent in spiral configuration and do not intersect.

The French patent specification 2411 373 discloses pipes curved in zig-zag configuration for a hot-water conduit system comprising two decks in which parallel, rectilinear pipe sections intersect in decks but an increased flow resistance offered by intersecting pipes does not come into effect in this known boiler because only two pipe decks are present and the flow direction of the firing gases is substantially parallel with the pipe decks.

2. Object of the Invention

It is an object of the invention to increase the efficiency of heat transfer between firing gases and the water to be heated in a hot water central heating system with pipe coils, installed in decks, as the hot water conduit system.

It is another object of the invention, by means of a relatively tall and nesting hot-water conduit system comprising pipes which intercommunicate in decks, to extract a quantity of heat from the firing gases so that the exhaust gases discharging into the chimney are cooled to less than 400 K. (approximately 130° C.).

It is another object of the invention to continuously regulate the fuel supply in a hot-water central heating system in which water is circulated by a circulating pump, by monitoring the hot water temperature and to provide means for momentarily shutting off the supply of fuel in the event of current failure and stoppage of the circulating pump and to avoid vapour formation in the pipe coils and therefore to avoid excess pressure in the totally enclosed water circulating through the entire heating system.

The invention comprises the features disclosed hereinbelow.

SUMMARY OF THE INVENTION

The hot-water conduit system according to the invention represents a flow resistance to the firing gases, resulting in reducing the velocity of the firing gases and increasing thermal transfer by convection, i.e. by direct action of the firing gases upon the conduit system. Depending on the choice of conduit spacing within a conduit deck and depending on the firing gas apertures defined thereby, also depending on the number of superjacent conduit decks it is possible, in co-operation with an exhaust gas butterfly flap, to obtain a suitable firing gas velocity without incurring the risk of back pressure. The pressure limiting valve in the hot-water outflow upstream of the circulating pump prevents vapour formation within the hot-water conduit system of the boiler in the event that a fault in the thermostatically controlled regulating system results in a supply of heat, due to the continuous supply of fuel, greater than the required amount of heat. The pressure limiting valve thus also enables the system to function without an overflow or without a pressure equalizing vessel.

The hot-water conduit system according to the invention is especially compact and effective, since the conduit decks are mounted in close superjacent configuration, in which the conduits are in contact and, where appropriate, are hard soldered to each other. The conduit system will then represent a unit which can be easily handled and installed and the points of contacts allow direct heat flow within the material of the conduit to the upper decks, thus preventing overheating of the lower decks of the conduit system.

Oil-fired central heating boilers normally operate with a burner and nozzle which is only intermittently switched on by a thermostatically controlled regulating system. The high flow resistance offered by a hot-water conduit system according to the invention, as well as the increased heat utilization of the firing gases, enable the heating boiler, equipped with a cup-like burner known from oil furnaces, to be provided with an oil supply which is continuously regulated by means of a thermostat disposed in the hot-water outflow. Such continuous regulating systems for oil-fired room heaters are known from the German patent specification 19 04 539 in which case however the thermostat is disposed in the convection chamber of the room heater.

The hot-water conduit system offering a high flow resistance to the firing gases leads to a reduction of the exhaust gas temperatures to an extent to which these drop below the value of the minimum exhaust gas temperatures specified by the authorities. These specified minimum temperatures apply to exhaust gas chimneys of conventional construction, i.e. chimneys embodied in brickwork or tiles. Hitherto, and resulting of necessity from a poor efficiency of heat transfer within the heating boiler, it was the practice to specify and adjust a relatively high exhaust gas temperature in order to counteract any destruction of the chimney due to precipitating condensate water. However, owing to the world-wide cost increase of heating fuels it appears essential in the first place to obtain optimum utilization of the calorific content of the fuel. From this point of view, the invention makes this possible in that the exhaust gas chimney of the heating system according to the invention is provided with a corrosion-resistant lining, for example with a pipe which is enamelled on the interior. Investment costs to this end are tolerable, given high fuel costs, because it is possible by means of the invention to achieve exhaust gas temperatures of substantially less than 400 K.

BRIEF DESCRIPTION OF THE DRAWINGS

One embodiment of a hot-water central heating system according to the invention is illustrated in the accompanying drawing in which.

DETAILED DESCRIPTION OF THE DRAWINGS AND PREFERRED EMBODIMENTS

Figure 1:
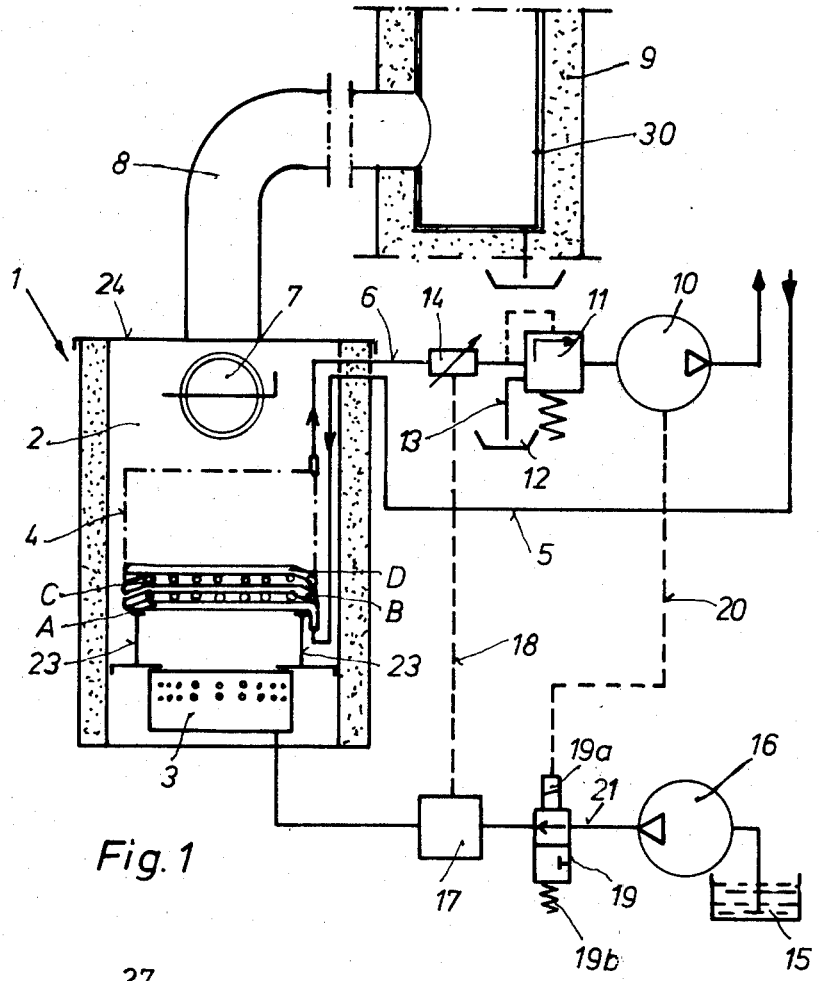
FIG. 1 is a diagrammatic view of the system with an oil-fired heating boiler and FIG. 2 is a plan view of a hot water conduit system with intersecting pipelines bricks which are situated in closely superjacent configuration.

The central heating system comprises a boiler 1 which surrounds a combustion chamber 2 in which the firing gases, rising from a cup-shape oil burner 3, flow through a hot-water conduit system 4. The conduit system 4 has a cold water inflow 5 and a hot water outflow 6. An exhaust gas butterfly flap 7 is disposed in the top zone of the boiler 1 and adjoins an exhaust gas duct 8. The latter extends into an exhaust gas chimney 9. Upstream of a circulating pump 10, a pressure limiting valve 11, with a discharge 13 extending into a collecting vessel 12, is disposed in the hot-water outflow 6. The valve 11 opens if the pressure in the conduit system 4 exceeds a specified maximum value, for example due to the formation of vapour. An adjustable heat sensitive means 14 thermostat 14, which monitors the temperature of the hot water, is also disposed in the hot water outflow 6. Water circulation in FIG. 1 is indicated by arrows. The cup-shaped burner 3 is supplied continuously with fuel oil from the oil tank 15 via a suction pump 16. The flow rate is regulated by a controller means 17 in accordance with the desired hot-water temperature to which the thermostat 14 is set, indicated by the signal line 18. Fuel oil flow rate regulation modulated in this manner is known for oil burner room heaters and need not be described in detail.

A two-way valve 19, whose electromagnet **19*a* is energized via the control line 20 only when the circulating pump 10 is in operation, is disposed between the suction pump 10 and the controller 17. In the event of current failure, the two-way valve 19 automatically changes over due to the force exerted by the spring 19*b*, and closes the oil duct 21**.

Figure 2:
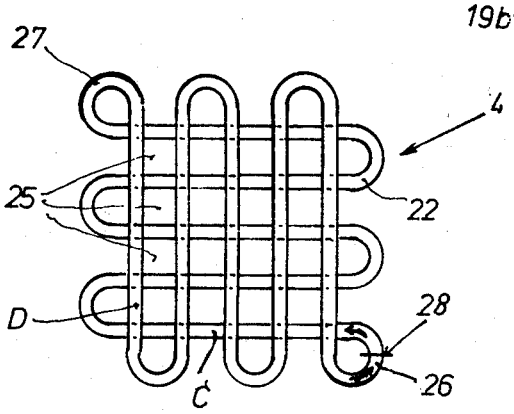

In the exemplified embodiment according to FIGS. 1 and 2, the hot water conduit system comprises a plurality of more than ten superjacent decks A, B, C, D and so on of conduits 22, bent in zig-zag configuration and communicating with each other in decks. Only four conduit decks are shown in FIG. 1 and the overall height of the conduit system 4 is indicated by dash-dot lines. The conduit system thus represents a compact stack of intersecting, closely superjacently disposed conduits which bears on supports 23 above the burner 3 and can be readily removed in the upward direction for cleaning purposes if the lid 24 of the boiler 1 is removed. FIG. 1 discloses that the hot water conduit system 4 fills almost the entire cross-section of the combustion chamber 2. The cross-section of the duct system 4 is greater than the diameter of the burner 3 so that the firing gases rise substantially through the apertures 25 formed by the intersecting conduits. In the exemplified embodiment illustrated in FIG. 1 the conduit decks A, B, C, D and so on are installed with the conduits in close superjacent configuration and with the intersecting places in physical contact with one another.

FIG. 2 discloses on two oppositely disposed corners of the conduit system 4 of approximately squre cross-section two conduit bends 26 and 27. Each of said conduit bends represents the connection of a conduit deck to the next higher conduit deck, which, as can be seen by reference to FIG. 1, extend at a slight upward angle at this so-called deck interchange. The conduit bend 26 is subdivided by a line 28 to indicate that the said conduit bend represents the inflow from a lower deck C from the deck B disposed therebelow as well as the outflow of the above-disposed deck D to the next higher deck. The bend 27 merely represents the transition from the deck C into the next higher deck D.

A hot-water conduit system 4 according to FIGS. 1 and 2 represents a substantial flow resistance to the firing gases which rise from the burner 3, so that heat transfer between the firing gases and the conduits, which communicate with each other in the upward direction exclusively through the decks, takes places substantially by convection. This makes it possible to obtain an exhaust gas temperature which would be so low that a conventional exhaust gas duct would be damaged by condensate water. To remedy this defect, the exhaust gas tube 8 extends into an exhaust gas chimney which is lined with an internally enamalled pipe 30. This enamel pipe is corrosion-resistant to condensate water.

What is claimed is:

1. A hot-water central heating system including a boiler, a combustion chamber within the boiler, a burner beneath the combustion chamber for producing hot firing gases, and a hot-water conduit system disposed above the burner, the conduit system being provided with a cold-water inflow and a hot-water outflow, and further comprising:

(a) a plurality of superjacent decks of conduits, said conduits of each deck being in parallel relationship within each deck, the conduits of one deck being oriented substantially crosswise with respect to the immediately adjacent decks;

(b) an adjustable heat-sensitive means being disposed in the hot-water outflow for monitoring the hot-water temperature, (c) means in the fuel supply for controlling the flow rate of fuel to be fed in a modulated manner into the burner; and (d) a signal line connected to said heat-sensitive means and said controlling means, whereby said controlling means continuously supplies fuel at a flow rate responsive to said heat-sensitive means in accordance with the desired hot-water temperature to which said heat-sensitive means is set, so the exhaust gases leaving the hot-water conduit system are cooled to a temperature of less than about 400 K. (approximately 130° C.).

2. The central heating system defined in claim 1 wherein said decks of conduits substantially fill the combustion chamber.

3. The central heating system defined in claim 1 wherein at least ten of said decks of conduits are provided.

4. The central heating system defined in claim 1 wherein said crosswise oriented decks are in contact with one another at points of intersection.

5. The central heating system defined in claim 4 wherein said points of intersection are soldered.

6. The central heating system defined in claim 1 further comprising a pressure limiting means in said hot water outflow.

7. The central heating system defined in claim 1 further comprising a corrosion-resistant chimney to receive exhaust gases from the boiler.

8. The method of hot water central heating comprising the steps of:

(a) providing a boiler including a combustion chamber, a burner beneath the combustion chamber to supply hot firing gases, in said combustion chamber a hot-water conduit system including a plurality of superjacent decks of conduits, said conduits of each deck being in parallel relationship within each deck, the conduits of each deck being oriented substantially crosswise with respect to the immediately adjacent decks, said conduit system having a cold-water inflow and a hot-water outflow extending outside said combustion chamber;

(b) circulating water through said conduit system from said cold-water inflow to said hot water outflow;

(c) placing an adjustable heat-sensitive means in said hot-water outflow, said heat-sensitive means being set to a desired temperature; and (d) continuously supplying modulated amounts of fuel from a fuel supply to said burner in response to said heat-sensitive means.

9. The method of claim 8 further including limiting the pressure in said conduit system by pressure limiting means placed in said hot water outflow.

10. The method of claim 9 further including increasing the flow resistance to said firing gases by increasing the number of said conduit decks in said combustion chamber, said conduit decks being oriented substantially crosswise with respect to one another.

11. The method of claim 8 wherein said conduits cool said firing gases leaving said boiler to about 400° K. (130° C.).

* * * * *